US006520592B1

(12) United States Patent
Bobholz

(10) Patent No.: US 6,520,592 B1
(45) Date of Patent: Feb. 18, 2003

(54) APPARATUS AND METHOD FOR DEMOLISHING PAVEMENT

(76) Inventor: Mark R. Bobholz, N8488 Pine Rd., Beaver Dam, WI (US) 53916

( * ) Notice: Subject to any disclaimer, the term of this patent is extended or adjusted under 35 U.S.C. 154(b) by 0 days.

(21) Appl. No.: 09/850,555

(22) Filed: May 7, 2001

(51) Int. Cl.[7] ..... E01C 23/12

(52) U.S. Cl. ..... 299/37.1; 299/37.3; 299/69; 299/100; 173/100; 173/211

(58) Field of Search ..... 299/69, 36.1, 37.1–37.5, 299/38.1, 100; 404/83, 85, 86, 90, 133.2; 37/403; 414/912; 172/245, 247, 253; 173/184–185, 100, 94, 89, 211

(56) References Cited

U.S. PATENT DOCUMENTS

| | | | | |
|---|---|---|---|---|
| 1,921,503 | A | 8/1933 | Calderwood | |
| 3,133,730 | A | 5/1964 | Cornett | |
| 3,150,724 | A | 9/1964 | Oelkers | |
| 3,181,627 | A | 5/1965 | Cornett | |
| 3,358,779 | A | 12/1967 | Cunningham | |
| 4,457,645 | A | 7/1984 | Klochko | |
| 4,732,506 | A | 3/1988 | Bays | |
| 4,785,893 | A | 11/1988 | Kistner | |
| 4,805,707 | A | 2/1989 | Davis et al. | |
| 4,984,639 | A | 1/1991 | Lindsey et al. | |
| 5,234,282 | A | 8/1993 | Osborn | |
| 5,393,127 | A | 2/1995 | Kimball, II | |
| 5,607,022 | A | 3/1997 | Walker et al. | |
| 5,662,177 | A | 9/1997 | Bosma | |
| 5,662,385 | A | 9/1997 | Bishop | |
| 5,813,479 | A | 9/1998 | Bosma | |
| 6,325,459 | B1 * | 12/2001 | Jaeger et al. | 299/37.3 |

* cited by examiner

*Primary Examiner*—David Bagnell
*Assistant Examiner*—Sunil Singh
(74) *Attorney, Agent, or Firm*—Andrus, Sceales, Starke & Sawall, LLP

(57) ABSTRACT

A pavement demolition hammer is removably fastened to a loader and includes a mounting plate securable to the loader. A framework is attached to the mounting plate and is provided with a lower spring and an upper spring spaced from the lower spring. A hammer handle has a proximal end pivotally mounted to the framework for swinging movement between the lower spring and the upper spring, and a distal end equipped with a hammer head adapted to engage the pavement. The loader applies a moving force to the mounting plate such that the lower spring is accelerated against the bottom of the handle causing the handle and the hammer head to swing upwardly from a pavement surface to be broken towards the upper spring. The handle and the hammer head return to the pavement surface either by gravity or acceleration from the upper spring against the top of the handle in a manner that the hammer head impacts and demolishes the pavement surface.

9 Claims, 6 Drawing Sheets

APPARATUS AND METHOD FOR DEMOLISHING PAVEMENT

FIELD OF THE INVENTION

This invention relates broadly to equipment and processes for breaking up concrete, asphalt and other pavement surfaces and, more particularly, pertains to a drop hammer arrangement which is conveniently attached for movement on a loader machine such as a skid steer.

BACKGROUND OF THE INVENTION

Pavement surfaces comprised of concrete, asphalt and the like occasionally need to be partially or completely removed with the aid of various construction equipment. One type of impact device in widespread use for breaking up and demolishing smaller areas of pavement surfaces is a pneumatic, manually-operated, jack hammer. For larger expanses of pavement to be broken, it is common to equip a loader, such as a backhoe or skid steer, with an impact hammer attachment. In each case, it is necessary to supply an air compressor or separate power source to operate the jack hammer or impact hammer. In addition, there is a significant amount of vibration and fatigue inflicted on the hammer operator and the environment is affected by the large volume of dust particles emanated into the air. Other problems associated with the use of conventional hammers include a high noise factor and the periodic need to fix leaking oil fittings or repair air hose ruptures.

Other types of dedicated demolition equipment are available for breaking up concrete and other hard pavement surfaces. However, such special purpose devices are expensive to acquire, operate and maintain, and are often not practical for contractors during occasional demolition work.

Several other loader-mounted, demolition apparatus are known which use swinging hammer heads and employ various spring arrangements to impart whipping action or provide a cushioning effect. These apparatus have been generally over-complicated, require significant movement of their loader device for operation, transmit vibration and shock to the human operator and are not always easily mounted on their loaders.

Accordingly, it is desirable to provide a demolition hammer which has a simplified structure and a cost which is affordable to small sized contractors. Such demolition hammer should be capable of easy attachment to any skid steer loader and of establishing a resonant vibration such that cracking of pavement occurs throughout a large area. In addition, the demolition hammer should employ a spring arrangement which not only has the ability to return a hammer with gravity motion to an impact point and increase the speed of the return, but also relies upon the springs to absorb shocks and vibrations so they are not felt by the operator.

SUMMARY OF THE INVENTION

It is one object of the present invention to provide an apparatus and method for demolishing pavement wherein a lower spring is utilized to accelerate a hammer handle and hammer head towards an upper spring, the hammer handle and the hammer head returning to an impact point on a pavement surface either by gravity or acceleration from the upper spring.

It is another object of the present invention to provide an apparatus and method for demolishing pavement wherein the apparatus may be quickly and universally mounted upon a skid steer loader without any electric, hydraulic or pneumatic connections.

It is also an object of the present invention to provide an apparatus and method for demolishing pavement which has a low noise factor and is operator friendly causing no fatigue on the human operator.

It is an additional object of the present invention to provide an apparatus and method for demolishing pavement which can deliver variable impacts at distances remote from the skid steer loader.

It is a further object of the present invention to provide an apparatus and method for demolishing pavement which is less expensive and less complicated than those of the prior art.

In one aspect of the invention, a pavement demolition hammer is removably fastened to a loader. A mounting plate is securable to the loader, and a framework is attached to the mounting plate and provided with a lower spring and an upper spring spaced from the lower spring. A hammer handle has a proximal end pivotally mounted to the framework for swinging movement between the lower spring and the upper spring, and a distal end is equipped with a hammer head adapted to engage the pavement. The loader applies a moving force to the mounting plate such that the lower spring is accelerated against the bottom of the handle causing the handle and the hammer head to swing upwardly from a pavement surface to be broken towards the upper spring, the handle and the hammer head returning to the pavement surface either by gravity or acceleration from the upper spring against the top of the handle in a manner that the hammer head impacts and demolishes the pavement surface. The mounting plate is a generally rectangular, planar surface having a V-shaped bracket at its upper end, and a rearwardly extending lip with a pair of spaced apertures at a lower end, the bracket and the lip being manually engagable with an adapter plate on the loader. The framework includes a horizontally extending fork bottom disposed perpendicularly and forwardly of the mounting plate, a vertically extending fork top rising from a rearward end of the fork bottom along a forward surface of the mounting plate, and an upwardly and forwardly extending fork extension connected to an upper end of the fork top. A forward end of the fork bottom carries a generally cylindrical, lower coil spring, and a forward end of the fork extension carries a generally cylindrical, upper coil spring. The framework further includes a pair of parallel, spaced apart side plates, each side plate being attached to the fork bottom, fork top and fork extension. The hammer handle is disposed to swing between the side plates. The hammer handle is provided with an upper spring plate engagable with the upper spring, and a lower spring plate engagable with the lower spring. The hammer handle is normally supported on the lower spring. The hammer head has a generally cylindrical configuration with a downwardly depending impact point. The hammer head extends beyond the forward end of the fork bottom.

In another aspect of the invention, a pavement demolishing hammer includes a loader having lifting arm structure, a hydraulic cylinder carried on the lifting structure and an adapter plate including a top end pivotally mounted to the hydraulic cylinder and a bottom end pivotally secured to the lifting arm structure, the bottom end provided with a spring loaded pin. A framework includes a mounting plate with a bracket at an upper end and an apertured lip at a lower end. The mounting plate bracket is engagable with the top end of the adapter plate and the spring loaded pin is engagable with the apertured lip. The framework further includes a horizontally extending fork bottom disposed generally perpendicularly to the mounting plate, a vertically extending fork top to which the mounting plate is secured, and an upwardly and forwardly extending fork extension connected to the fork top. A generally cylindrical, lower coil spring is disposed on the fork bottom and a generally cylindrical, upper coil spring is located on the fork extension. A pair of spaced apart, side plates is provided, each being attached to the fork bottom, fork top and the fork extension. A hammer handle has a rearward end pivotally attached to the fork top for pivotal movement between the side plates and between the upper spring and the lower spring, and a forward end provided with a hammer head adapted to engage the pavement. Selective actuation of the hydraulic cylinder moves the mounting plate and framework such that the lower spring is accelerated against the bottom of the handle causing the handle and hammer head to swing upwardly from the pavement towards the upper spring. The handle and the hammer head return to the pavement either by gravity or acceleration from the upper spring against the top of the handle in a manner that the hammer head impacts the pavement.

In yet another aspect of the invention, there is contemplated a method of demolishing pavement including the steps of a) providing a framework with a lower spring and an upper spring spaced from the lower spring; b) providing a hammer handle having a proximal end pivotally mounted to the framework between the lower spring and the upper spring, and a distal end equipped with a hammer head adapted to engage the pavement; and c) moving the framework such that the lower spring is accelerated against a bottom of the handle causing the handle and the hammer head to swing upwardly from a pavement surface towards the upper spring, the handle and the hammer head returning to the pavement surface either by gravity or acceleration from the upper spring against a top of the handle in a manner such that the hammer head impacts and demolishes the pavement surface.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings.

DETAILED DESCRIPTION OF THE INVENTION

Figure 1:
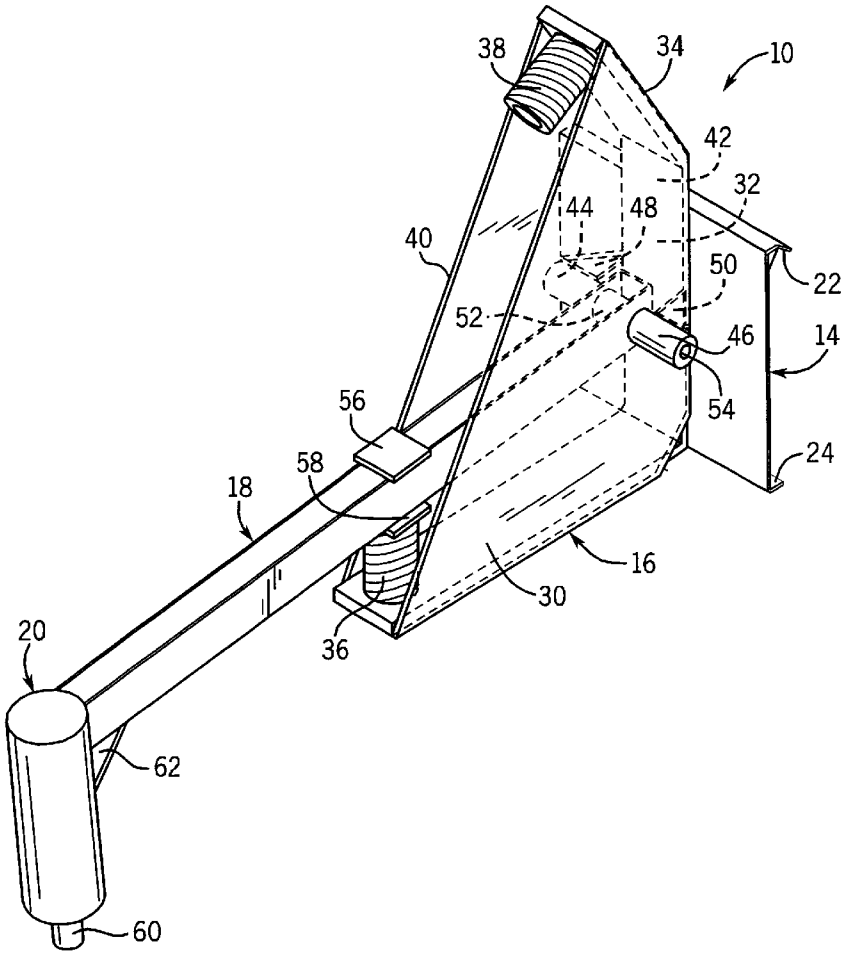
FIG. 1 is a perspective view of a pavement demolition hammer embodying the present invention.

Referring now to the drawings, FIG. 1 illustrates a demolition hammer 10 which is particularly useful in breaking up and demolishing hard pavement such as concrete, asphalt and the like. In the ensuing figures, it should be appreciated that the hammer 10 is designed to be conveniently and quickly coupled to any type of skid steer loader 12 which provides the moving force to make the hammer 10 operational.

In FIG. 1, the hammer 10 is shown as a stand alone attachment which is supported on a ground surface and fabricated so that it will maintain an upright position and not tip over. Hammer 10 has a simple yet efficient and sturdy construction generally comprised of a mounting plate 14, a framework 16 and a hammer handle 18 having a hammer head 20 for impacting and cracking a pavement surface.

Mounting plate 14 has a generally rectangular planar surface having an upper end provided with a downwardly opening, V-shaped bracket 22 and a lower end equipped with a rearwardly extending lip 24 with a pair of spaced apart apertures, one being seen at 26. As will be understood below, the bracket 22 and lip 24 are engagable with mating structure on an adapter plate 28 on the skid steer loader 12.

The framework 16 is welded or otherwise fixedly joined to the forward surface of the mounting plate 14 and has a width which is less than that of the mounting plate 14. The framework 16 includes a horizontally extending, plate like, fork bottom 30 projecting perpendicularly relative to the mounting plate 14, a vertically extending, plate like fork top 32 rising from the rearward end of the fork bottom 30 along the height of the mounting plate 14, and an upwardly and forwardly extending, plate like, fork extension 34 connected to the top end of the fork top 32. In the preferred embodiment, the fork extension 34 lies at an obtuse angle of about 125 degrees relative to the fork top 32. The forward end of the fork bottom 30 is provided with a generally cylindrical, lower spring coil 36, while the forward end of the fork extension 34 carries a generally cylindrical, upper coil spring 38. A pair of spaced apart, solid side plates 40, 42 are each connected to respective side edges of the fork bottom 30, fork top 32 and fork extension 34. Each side plate 40, 42 is constructed with a horizontal inline, tubular bushing 44, 46 projecting laterally therefrom. Each bushing 44, 46 is connected by a gusset 48, 50 to the fork top 32.

The hammer handle 18 is generally an elongated, square tube having a rearward end which carries a central pivot bushing 52 interposed between the inline bushings 44, 46 projecting through the side plates 40, 42. A pivot pin 54 is placed through aligned openings on the inline bushings 44, 46 and pivot bushing 52 to define a pivotal mounting for the handle 18. A mid portion of the handle 18 has an upper spring plate 56 which is disposed on the top of the handle 18, and a lower spring plate 58 which is located on the bottom of the handle 18. The upper spring plate 56 is engagable with the upper spring 38, and the lower spring plate 58 is engagable with the lower spring 36. A forward end of the handle 18 carries the hammer head 20 which is a steel cylinder having a downwardly depending impact point 60. The hammer head 20 is supplementally attached to the handle 18 by gusset structure 62. In its normal rest position, the handle 18 is supported upon the lower coil spring 36.

With this construction, the handle 18 is swingable upwardly and downwardly between the side plates 40, 42, and between the lower coil spring 36 and the upper coil spring 38.

Figure 2A:
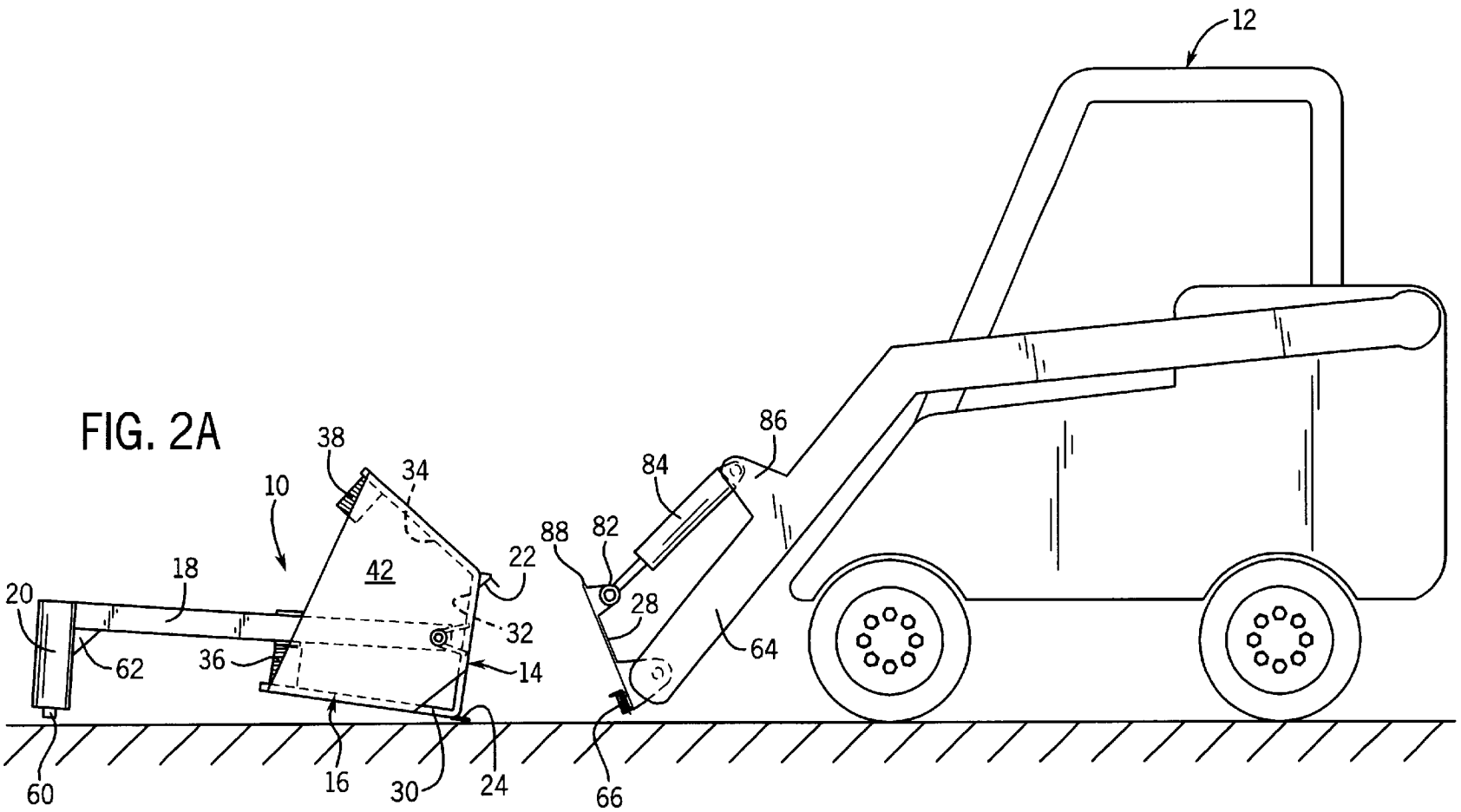
FIG. 2A is a side view of the demolition hammer about to be coupled to the front end of a skid steer loader.
Figure 2B:
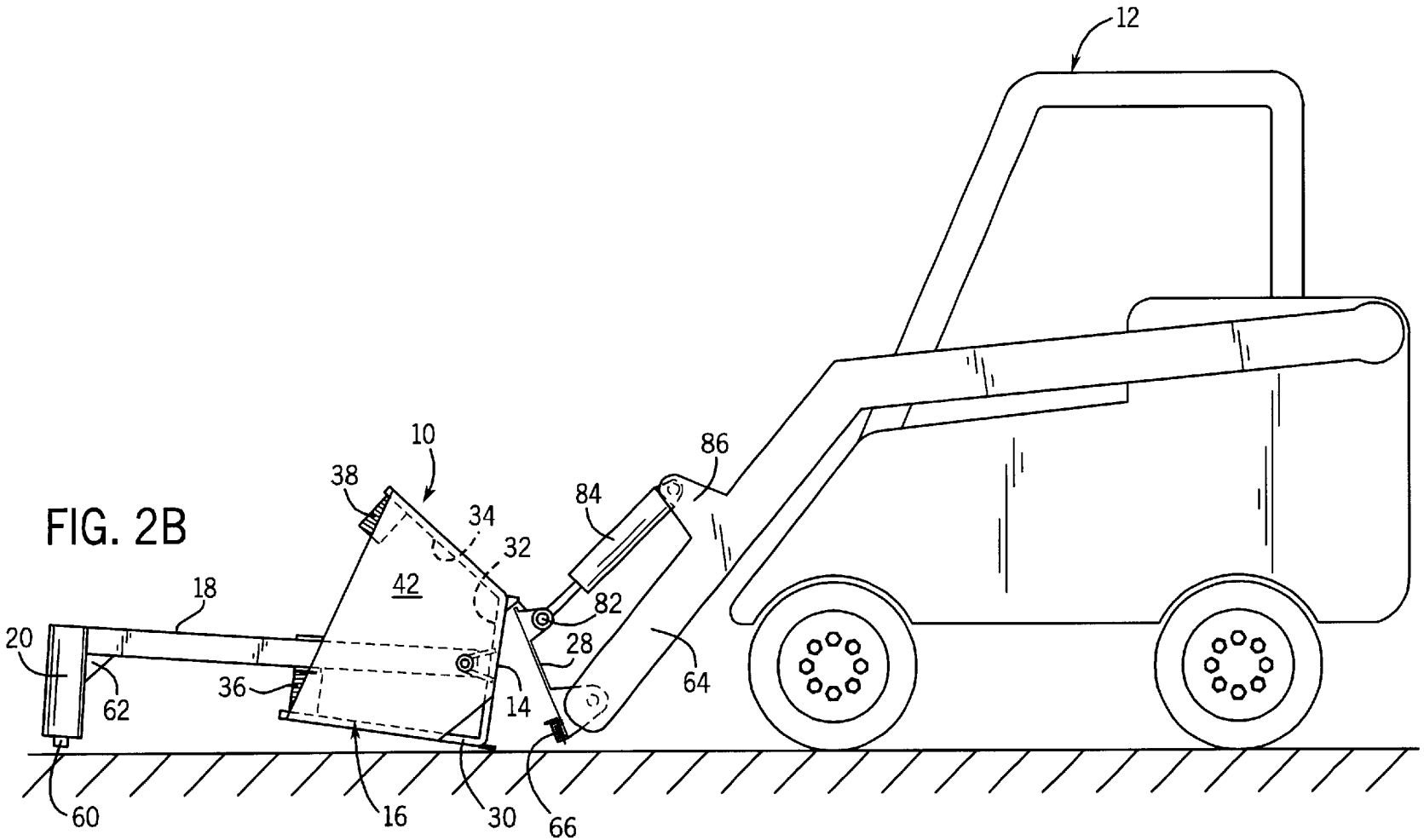
FIG. 2B is a view like FIG. 2A showing the initial engagement of the demolition hammer with the skid steer loader.
Figure 2C:
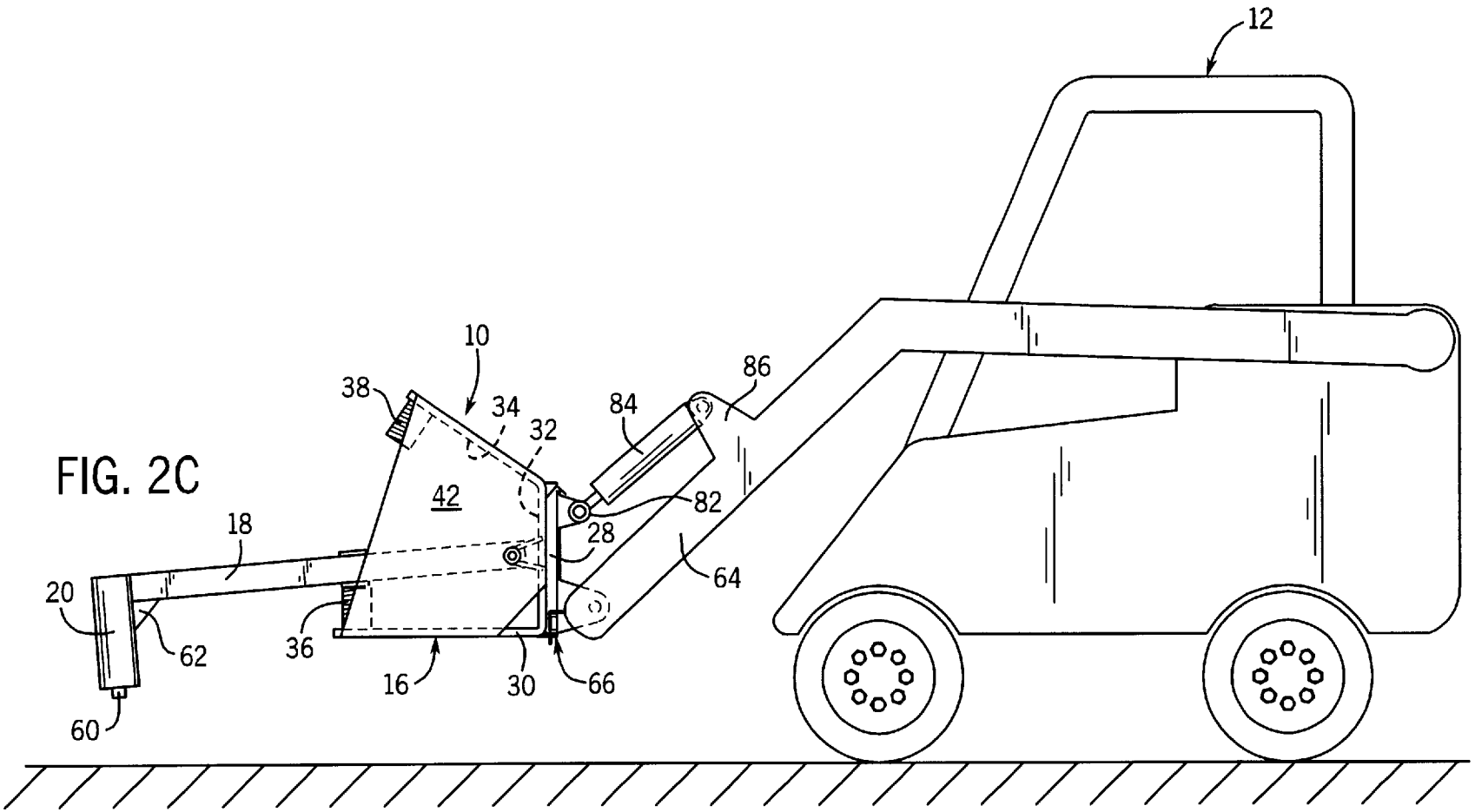
FIG. 2C is a view like FIG. 2B showing the demolition hammer attached to the skid steer loader and raised from the ground.
Figure 3B:
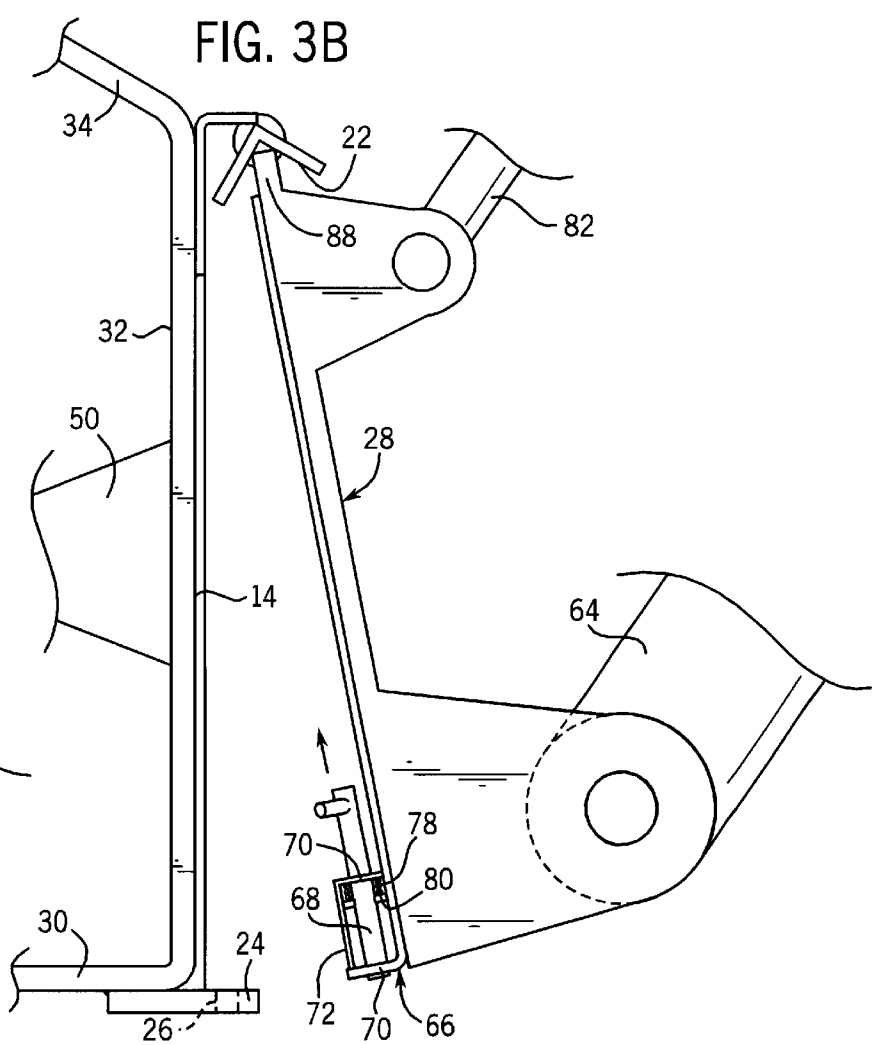
FIG. 3B is an enlarged, detail view showing the initial engagement between the mounting plate of the demolition hammer and the adapter plate of the skid steer loader.
Figure 3A:
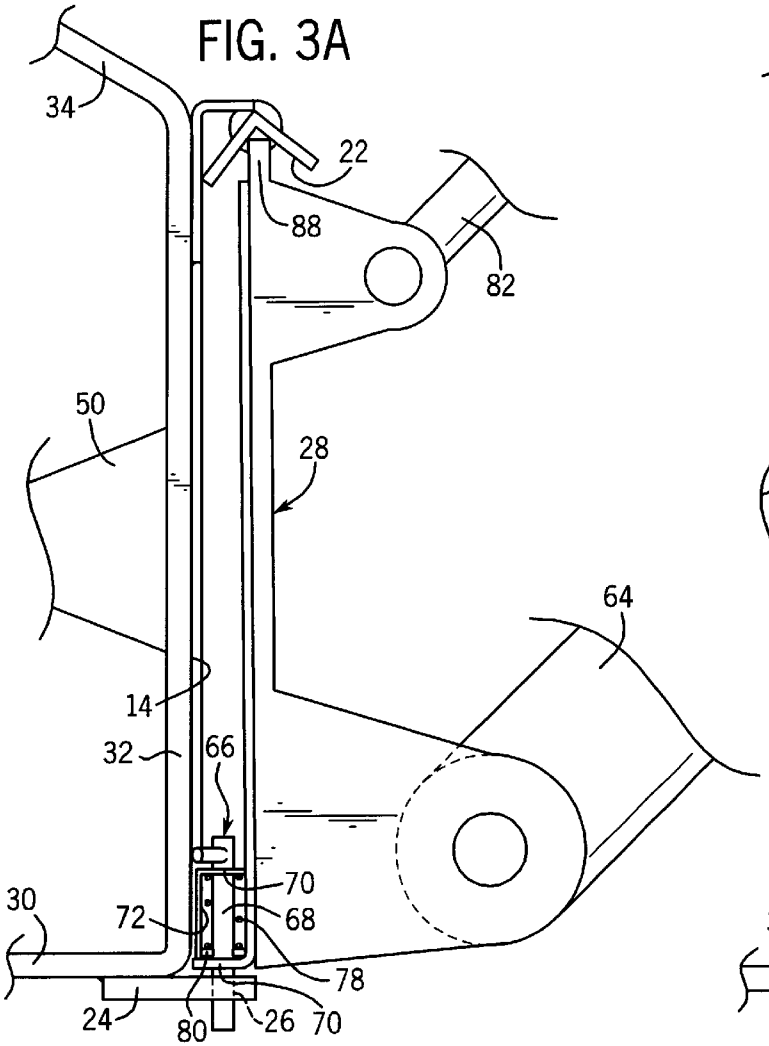
FIG. 3A is an enlarged, detail view showing the full engagement of a mounting plate of the demolition hammer with an adapter plate on the skid steer loader.

As seen in FIGS. 2A through 2C, 3A, 3B, and 4A through 4C, the hammer 10 described above is designed to be removably attached to skid steer loader 12 by means of the mounting plate 14 and the mating adapter plate 28. With particular reference to FIGS. 2A, 3A and 3B, the adapter plate 28 is a generally rectangular planar surface which is generally coextensive in surface area with the mounting plate 14. The lower end of the adapter plate 28 is pivotally connected to downwardly extending arms 64 of the skid steer loader 14. The lower end of the adapter plate 28 is also provided with a conventional, spring loaded pin arrangement 66. This arrangement includes an elongated movable pin 68 on each side of the adapter plate 28 which passes through aligned apertures 70 in a keeper 72 on each side and through an aperture 74 formed on opposing sides in a forwardly extending ledge 76. Each pin 68 is normally biased upwardly (as shown by the arrow in FIG. 3B) by a coil spring 78 which is positioned between the top of the keeper 72 and a collar 80 surrounding the pin 68. Each pin 68 may be forced downwardly against the bias of the spring 78 to engage with the apertured lip 24 on the mounting plate 14. The bottom of each pin 68 is provided with cam or detent structure to hold the pin in place when the pin is moved downwardly against its spring 78. The upper end of the adapter plate 28 is pivotally secured to a rod end 82 of a hydraulic tilt cylinder 84 normally used to move the bucket (not shown) of the skid steer loader 14. The bucket is normally detachably coupled to the skid steer loader 14 by means of the adapter plate 28. A casing end of the cylinder 84 is pivotally connected to an extension 86 on the arms 64. The upper end of the adapter plate 28 is also formed with an upstanding surface 88 which is engagable with the mounting plate bracket 22.

When it is desired to use the hammer 10, the skid steer loader 14 approaches the ground-based, stationary hammer 10 from the rear of the mounting plate 14 (FIG. 2A). Using the tilt cylinder 84, the skid steer operator moves the upper end of the adapter plate 28 into engagement with the mounting plate bracket 22 (FIG. 2B, 3B). Further movement of the cylinder 84 pivots the adapter plate 28 into the engagement position of FIG. 3A at which point a worker employs the pin arrangement 66 to couple the mounting plate 14 and the hammer 10 to the adapter plate 28 and loader 14. Thereafter, the attached hammer 10 can be raised via the loader arms 64 and moved to a desired location where pavement is to be demolished (FIG. 2C).

Figure 4A:
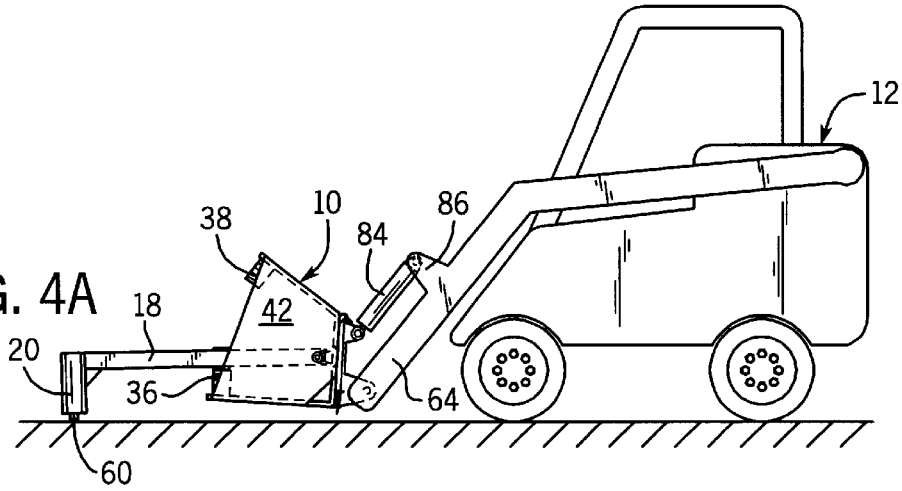
FIGS. 4A through 4C are side views showing the progressive manner in which the demolition hammer is used when coupled on the skid steer loader.
Figure 4B:
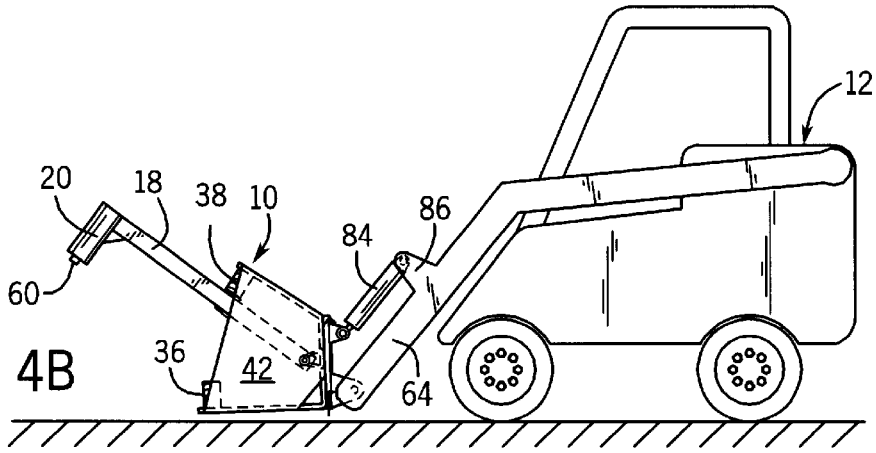
Figure 4C:
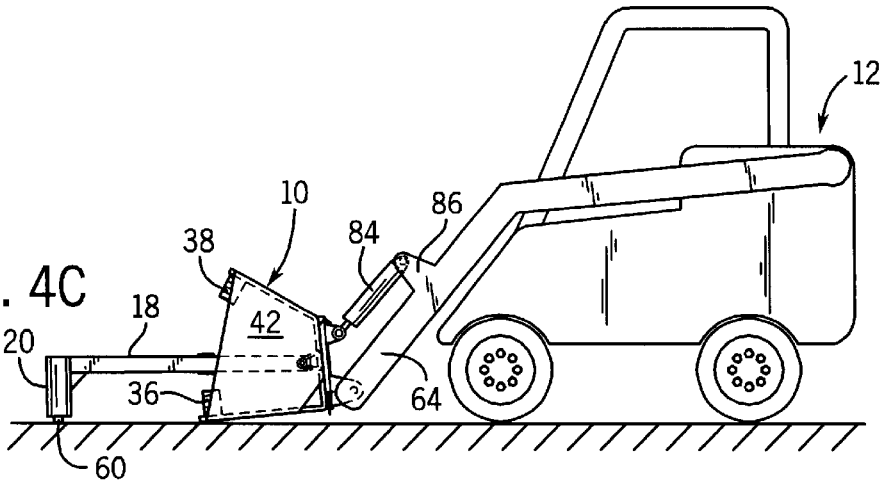

To begin pavement destruction, the loader arms 64 are lowered to bring the hammer 10 to the pavement surface (FIG. 4A). Here, the loader operator tilts the mounting plate 14 downward to a position allowing the impact point 60 of the hammer head 20 to contact the pavement surface. With a quick movement of the cylinder control, tilting the mounting plate 14 upward, the lower coil spring 36 is accelerated against the bottom of hammer handle 18. The resulting contact applies a force causing the handle 18 to swing upward. The amount of tilt movement defines the distance the handle 18 swings upward. Immediately after the loader operator tilts the mounting plate 14 upward, the mounting plate 14 is tilted downward to allow the handle 18 to return to the surface. If the operator tilts the mounting plate 14 upward hard enough, the handle 18 will travel to a position (FIG. 4B) where the upper coil spring 38 will absorb energy and prevent over travel and accelerate the handle 18 back towards the surface (FIG. 4C). Any shocks or vibrations are absorbed by the upper and lower springs 36, 38 which stop fatigue to the skid steer loader 12.

The hammer head 20 returns to the surface either by gravity or by acceleration from the upper coil spring 38 depending on the operator's needs. The hammer head 20 then impacts the surface causing the surface material to yield. The impact is magnified by a much smaller point 60 located on the center, bottom of the hammer head 20. The entire process is repeated until the operator has reduced the surface material to a manageable size for removal. The operator then moves the skid steer loader 12 with the attachment 10 to an adjacent area and begins again. When the required area of surface material is broken up, the operator can drop the attachment 10 from the skid steer loader 12 by using the spring pins 68 to disconnect the mounting plate 14 from the adapter plate 28, and install the standard bucket to begin removal of the material.

It should now be appreciated that the present invention provides a pavement demolition hammer which is low maintenance, low decibel and is environmentally friendly. This demolition hammer has a simplified, yet rugged construction with identical, interchangeable parts. Such hammer is noteworthy because it establishes a resonant vibration in the pavement so that cracking occurs throughout a larger area instead of simply penetrating a hole in a slab. The hammer has a quick recycle time with no latches or pins to catch and no stop hammer action between drops. The inventive design allows for 360 degrees motion of the loader to easily reach any direction and access corner work in an efficient manner. The hammer is an attractive cost alternative to more expensive breaking equipment.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. A pavement demolition hammer removably fastened to a loader, comprising:

a mounting plate securable to the loader;

a framework attached to the mounting plate and provided with a lower spring and an upper spring spaced from the lower spring; and a hammer handle having a proximal end pivotally mounted to the framework for swinging movement between the lower spring and the upper spring, and a distal end equipped with a hammer head adapted to engage the pavement, whereby the loader applies a moving force to the mounting plate such that the lower spring is accelerated against a bottom of the handle causing the handle and the hammer head to swing upwardly from a pavement surface to be broken towards the upper spring, the handle and the hammer head returning to the pavement surface either by gravity or acceleration from the upper spring against a top of the handle in a manner such that the hammer head impacts and demolishes the pavement surface, wherein the mounting plate is a generally rectangular planar surface having a V-shaped bracket at an upper end, and a rearwardly extending lip with a pair of spaced apertures at a lower end, the bracket and the lip being removably engagable with an adapter plate on the loader, and wherein the framework includes a horizontally extending fork bottom disposed perpendicularly and forwardly of the mounting plate, a vertically extending fork top rising from a rearward end of the fork bottom along a forward surface of the mounting plate, and an upwardly and forwardly extending fork extension connected to an upper end of the fork top.

2. The demolition hammer of claim 1, wherein a forward end of the fork bottom carries the lower spring, and a forward end of the forked extension carries the upper spring, both the upper and lower springs being generally cylindrical coil springs.

3. The demolition hammer of claim 2, wherein the framework further includes a pair of parallel, spaced apart side plates, each side plate being attached to the fork bottom, fork top and fork extension.

4. The demolition hammer of claim 3, wherein the hammer handle is disposed to swing between the side plates.

5. The demolition hammer of claim 2, wherein the hammer handle is provided with an upper spring plate engagable with the upper spring, and a lower spring plate engagable with the lower spring.

6. The demolition hammer of claim 2, wherein the hammer handle is normally supported on the lower spring.

7. The demolition hammer of claim 2, wherein the hammer head extends beyond the forward end of the fork bottom.

8. The demolition hammer of claim 1, wherein the hammer head has a generally cylindrical configuration with a downwardly depending impact point.

9. A pavement demolishing hammer comprising:

a loader having lifting arm structure, a hydraulic cylinder carried on the lifting structure and an adapter plate including a top end pivotally connected to the hydraulic cylinder and a bottom end pivotally secured to the lifting arm structure, the bottom end formed provided with a spring loaded pin;

a framework including a mounting plate with a bracket having an upper end and an apertured lip at a lower end, the mounting plate bracket being engagable with the top end of the adapter plate and the spring loaded pin being engagable with the apertured lip, the framework further including a horizontally extending fork bottom disposed generally perpendicularly to the mounting plate, a vertically extending fork top to which the mounting plate is secured, and an upwardly and forwardly extending fork extension connected to the fork top, there being a lower cylindrical coil spring disposed on the fork bottom and an upper cylindrical coil spring located on the fork extension and a pair of spaced apart side plates, each attached to the fork bottom, fork top and fork extension; and a hammer handle having a rearward end pivotally attached to the fork top for pivotal movement between the side plates, and between the upper spring and the lower spring, and a forward end provided with a hammer head adapted to engage the pavement, whereby selective actuation of the hydraulic cylinder moves the mounting plate and framework such that the lower spring is accelerated against a bottom of the handle causing the handle and the hammer head to swing upwardly from the pavement towards the upper spring, the handle and the hammer head returning to the pavement either by gravity or acceleration from the upper spring against a top of the handle in a manner that the hammer head impacts the pavement.

* * * * *